US005520292A

United States Patent [19]

Lombardi

[11] Patent Number: 5,520,292

[45] Date of Patent: May 28, 1996

[54] PERCUSSION INSTRUMENT MOUNTING APPARATUS

[76] Inventor: Donald G. Lombardi, 2118 E. Hillcrest Dr., Thousand Oaks, Calif. 91360

[21] Appl. No.: 243,372

[22] Filed: May 16, 1994

[51] Int. Cl.[6] ..... A47F 7/00

[52] U.S. Cl. ..... 211/13; 211/182; 211/189; 211/207; 211/195; 84/421; 248/166; 248/297.21; 248/298.1

[58] Field of Search ..... 211/189, 182, 211/13, 191, 207, 204, 195, 168; 84/453, 421; 248/163.1, 166, 228, 225.1, 225.31, 298, 297.2, 316.1, 316.6

[56] References Cited

U.S. PATENT DOCUMENTS

| | | | |
|---|---|---|---|
| 982,302 | 1/1911 | Roncaglia | 248/166 |
| 1,849,305 | 3/1932 | Magarian | 248/298 |
| 3,612,585 | 10/1971 | Mayr | 211/189 X |
| 3,847,489 | 11/1974 | Van Ripper | 248/297.2 X |
| 3,945,291 | 3/1976 | Zickos | 84/421 |
| 4,579,229 | 4/1986 | Porcaro et al. . | |
| 4,936,471 | 6/1990 | Walter | 211/206 X |
| 5,182,416 | 1/1993 | Schweizer | 84/421 X |
| 5,337,646 | 8/1994 | Austin | 84/421 |

*Primary Examiner*—Robert W. Gibson, Jr.
*Attorney, Agent, or Firm*—William W. Haefliger

[57] ABSTRACT

An articulated support apparatus for percussion instruments comprising first, second and third upright legs, a primary elongated bar structure extending generally horizontally between and supported by the first and second legs, and a secondary elongated bar structure extending generally horizontally between and supported by the second and third legs; the primary bar structure including multiple primary elongated segments, and there being a primary hinge structure connecting at least two of the primary segments to relatively pivot about a primary vertical primary hinge axis, and whereby the second and first legs may be selectively relatively pivoted about the axis; and support structure on at least one of the bar structures to support percussion instruments; the bar segments having substantially rectangular cross sections to slidably support said support structure.

21 Claims, 6 Drawing Sheets

PERCUSSION INSTRUMENT MOUNTING APPARATUS

BACKGROUND OF THE INVENTION

This invention relates generally to racks for supporting percussion instruments, and more particularly, to adjustable racks for such purposes.

Drummers using a variety of percussion instruments encounter the problem of supporting such instruments in fixed, relative positions; and drummers have need to set up such supports in a rapid, secure manner. There is need for improved apparatus meeting these and other percussion support requirements.

SUMMARY OF THE INVENTION

It is a major object of the invention to provide articulated support apparatus for percussion instruments meeting the above needs. Basically, the apparatus comprises:

a) first, second and third upright legs, a primary elongated bar structure extending generally horizontally between and supported by the first and second legs, and a secondary elongated bar structure extending generally horizontally between and supported by the second and third legs, b) the primary bar structure including multiple primary elongated segments, and there being a primary hinge structure connecting at least two of the primary segments to relatively pivot about a primary vertical primary hinge axis, and whereby the second and first legs may be selectively relatively pivoted about the axis, c) and support means on at least one of the bar structures to support percussion instruments, the bar segments having substantially rectangular cross sections to slidably support the support means.

Typically, such apparatus may advantageously include primary height adjustment means on the two primary segments and on the first and second legs for enabling adjustment of the elevation of the primary bar structure relative to the first and second legs; and typically, there are two of such primary segments, on each of which a percussion instrument may be supported in adjusted position by articulation of such segments and height adjustment thereof.

It is another object of the invention to provide secondary bar structure that includes multiple secondary, elongated segments, and there being a secondary hinge structure connecting at least two of the secondary segments to relatively pivot about a secondary, vertical hinge axis, and whereby the third and second legs may be relatively pivoted about the secondary vertical axis. Two of such secondary segments may be provided, and on each of which a percussion instrument may be supported in adjusted position selected by articulation of such secondary segments, and by height adjustment thereof.

Yet another object includes provision of primary pivot structure associated with the primary height adjustment means and enabling pivoting of at least one of the primary segments relative to its associated leg to thereby enable adjustment of the primary height adjustment means. Such primary pivot structure may enable pivoting of each of two primary segments relative to its associated leg. Likewise, secondary pivot structures may be provided in association with the secondary height adjustment means to enable pivoting of at least one of the secondary segments relative to its associated leg to thereby enable adjustment of the secondary height adjustment means; and each of two secondary segments may be pivoted relative to its associated leg, to enable adjustment of the secondary height adjustment means.

A further object is to provide one segment to have vertical sliding tongue and groove connection to one of the first and second legs, there being a clamp adjustable to clamp or loosen the connection after relative pivoting of the one segment and its associated leg. In this regard, each of two segments may have such sliding tongue and groove connections to the respective first and second legs, as will appear.

Also provided are vertical adjustments on the segments, whereby the percussion instruments may be elevated or loosened relative to the segments.

A wide degree of horizontal and vertical relative adjustment of percussion instruments is thereby provided, by means of an improved articulated rack, which is collapsible and extensible quite rapidly for ease of setup and transport, and which provides positive, fixed support for percussion instruments.

These and other objects and advantages of the invention, as well as the details of an illustrative embodiment, will be more fully understood from the following specification and drawings, in which:

DRAWING DESCRIPTION

GENERAL DESCRIPTION

Figure 1:
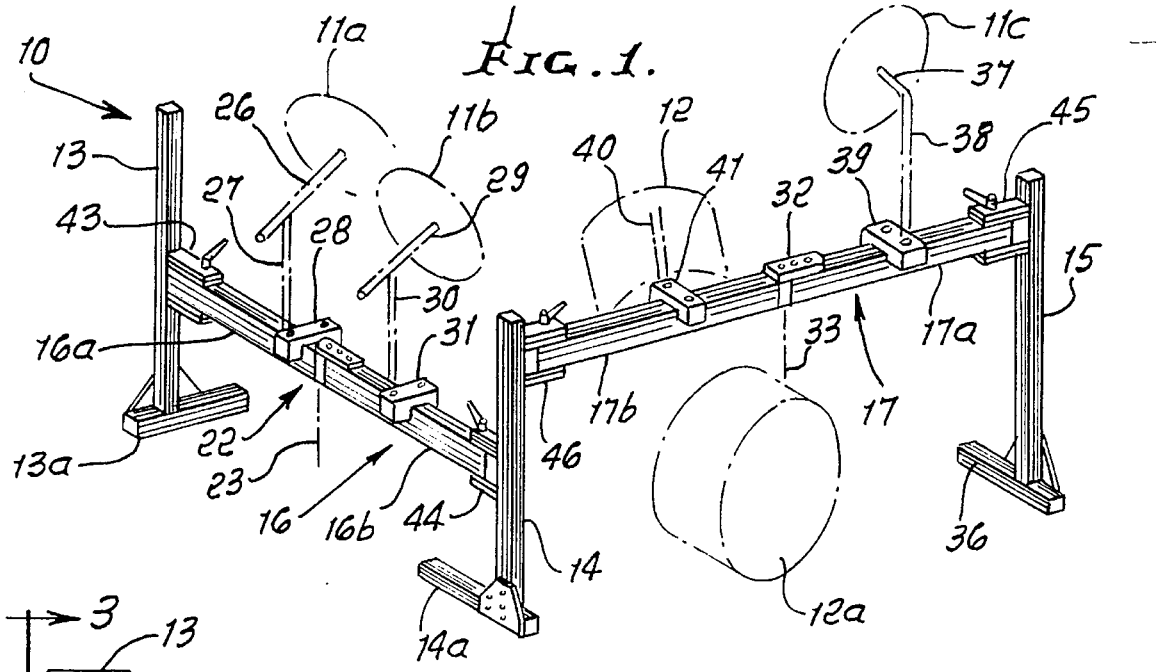
FIG. 1 is a perspective view of articulated support apparatus embodying the invention.

Referring first to FIG. 1, the articulated support apparatus is shown at 10 and is used to adjustably support percussion instruments, such as cymbals 11*a*, 11*b*, and 11*c*, and a drum 12. Other such instruments may be supported. The invention allows rapid set-up of such instruments on the apparatus 10, which is adjustable to move the instruments up and down, and in at least two dimensions (X-Y) horizontally, and in additional dimensions X' and Y'. See arrows X and Y, and X' and Y', in FIG. 2. The drummer may sit in the area designated at A in FIG. 2.

The apparatus 10 includes first, second and third upright legs 13, 14 and 15 respectively. It also includes a primary elongated bar structure 16 extending generally horizontally between and supported by the first and second legs 13 and 14, and a secondary elongated bar structure 17 extending generally horizontally between and supported by the second and third legs 14 and 15. A bass drum 12*a* is indicated below bar structure 17.

The primary bar structure 16 includes multiple elongated segments, only two such segments 16*a* and 16*b* being shown. A primary hinge structure connects at least two of such bar elements to pivot about a primary vertical hinge axis. Such a hinge structure 22 connects segments 16*a* and 16*b*, and defines a vertical hinge axis 23. Accordingly, the first and second legs 13 and 14 may be selectively relatively pivoted about that axis. Note in FIG. 2 that leg 13 and bar segment 16*a* are pivoted to broken line position 16*a'* shown. Leg 13 has a bottom horizontal support 13*a* that pivots with leg 13 as to position 13*a'*. A large number of such pivoted positions may be selected, as desired. The position of cymbals 11*a* may thereby be adjusted horzontally relative to cymbals 11*b*, since 11*a* is supported via arms 26 and 27, and support 28, on segment 16*a*, and since cymbals 11*b* is supported via arms 29 and 30, and support 31, on segment 16*b*.

In similar manner, the secondary bar structure 17 includes multiple elongated secondary segments, only two such segments 17*a* and 17*b* being shown. A secondary hinge structure connects at least two of such bar elements to pivot about a secondary vertical hinge axis. Such a hinge structure 32 connects 17*a* and 17*b*, and defines a vertical hinge axis 33. Accordingly, the second and third legs 14 and 15 may be selectively relatively pivoted about that axis.

Figure 2:
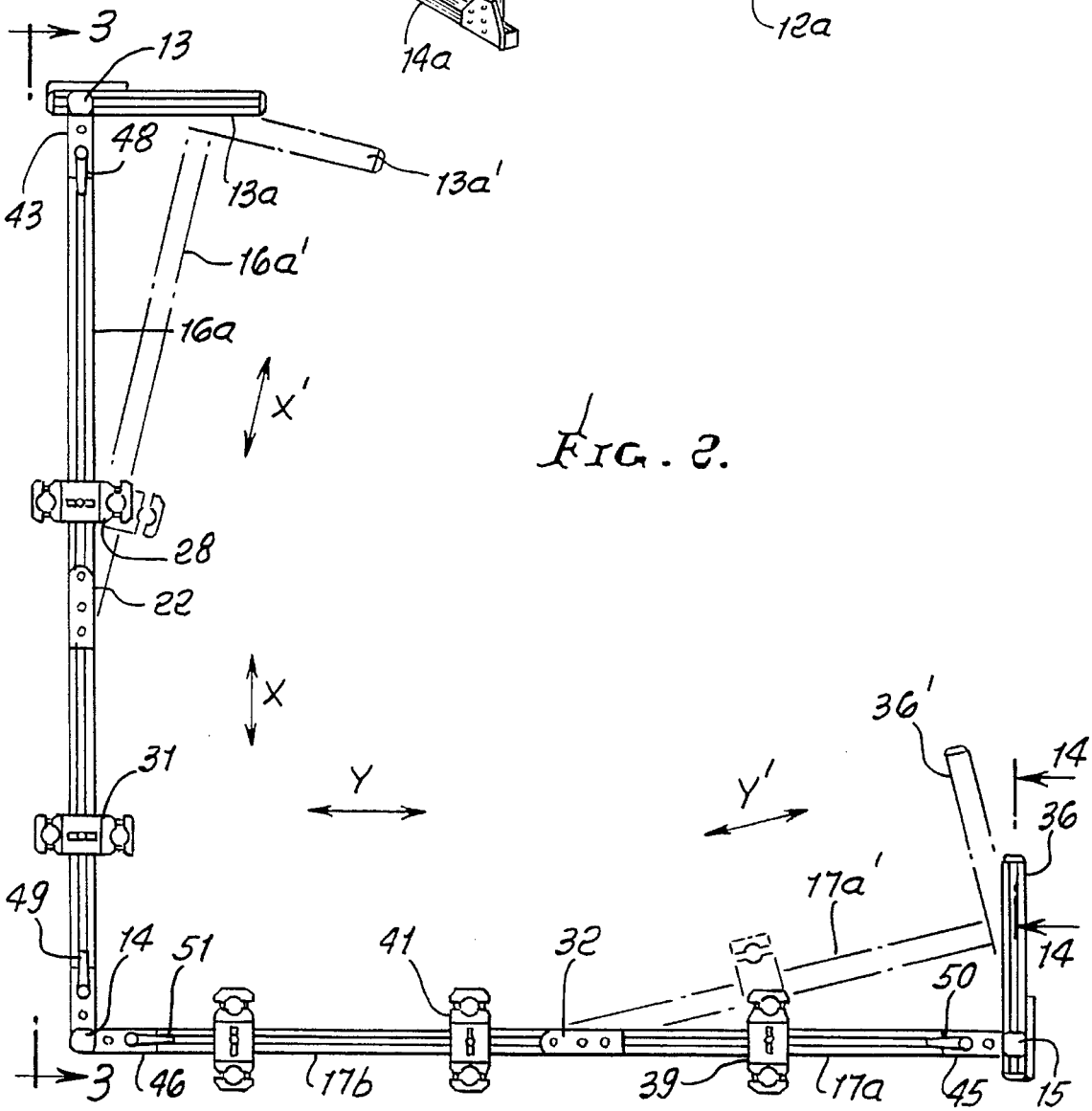
FIG. 2 is an enlarged top plan view of the FIG. 1 apparatus.

Note in FIG. 2 that leg 15 and bar segment 17*a* are pivoted to a broken line position 17*a'*. Leg 15 has a bottom horizontal foot or support 36 that pivots with leg 15 as to a position 36*a'*. A large number of such relatively pivoted positions may be selected. The position of cymbals 11*c* may thereby be adjusted horizontally relative to drum 12, and to cymbals 11*a* and 11*b*, since cymbals 11*c* is supported via arms 37 and 38, and support 39, on segment 17*b*, and since drum 12 is supported via arm 40 and support 41 on segment 17*b*. See also foot 13*a* supporting leg 13, and foot 14*a* supporting leg 14.

Primary height adjustment means is provided on primary bar segments 16*a* and 16*b*, and on first and second legs 13 and 14, for enabling adjustment of the elevation of the primary bar structure 16 relative to those legs. See adjustment means indicated at 43 and 44. Likewise, secondary height adjustment means is provided on secondary bar segments 17*a* and 17*b*, and on third and second legs 15 and 14 for enabling adjustment of the elevation of the secondary bar structure 17 relative to the legs. See adjustment means indicated at 45 and 46. These adjustments enable height adjustment of instruments 11*a* and 11*b* relative to instruments 11*c* and 12, and vice versa. They also enable each leg to be pivoted relative to its associated bar segment and about a vertical axis, as will be seen.

In addition, primary pivot structure 48 is associated with primary height adjustment means 43 to enable relative pivoting of segment 16*a* and leg 18; primary pivot structure 49 is associated with primary height adjustment means 44 to enable relative pivoting of segment 16*b* and leg 14; secondary pivot structure 50 is associated with secondary height adjustment means 45 to enable relative pivoting of segment 17*a* and leg 15; and secondary pivot structure 51 is associated with secondary height adjustment means 46 to enable relative pivoting of segment 17*b* and leg 14. These pivot structures enable height adjustment, as referred to.

DETAILED DESCRIPTION

Figure 5:
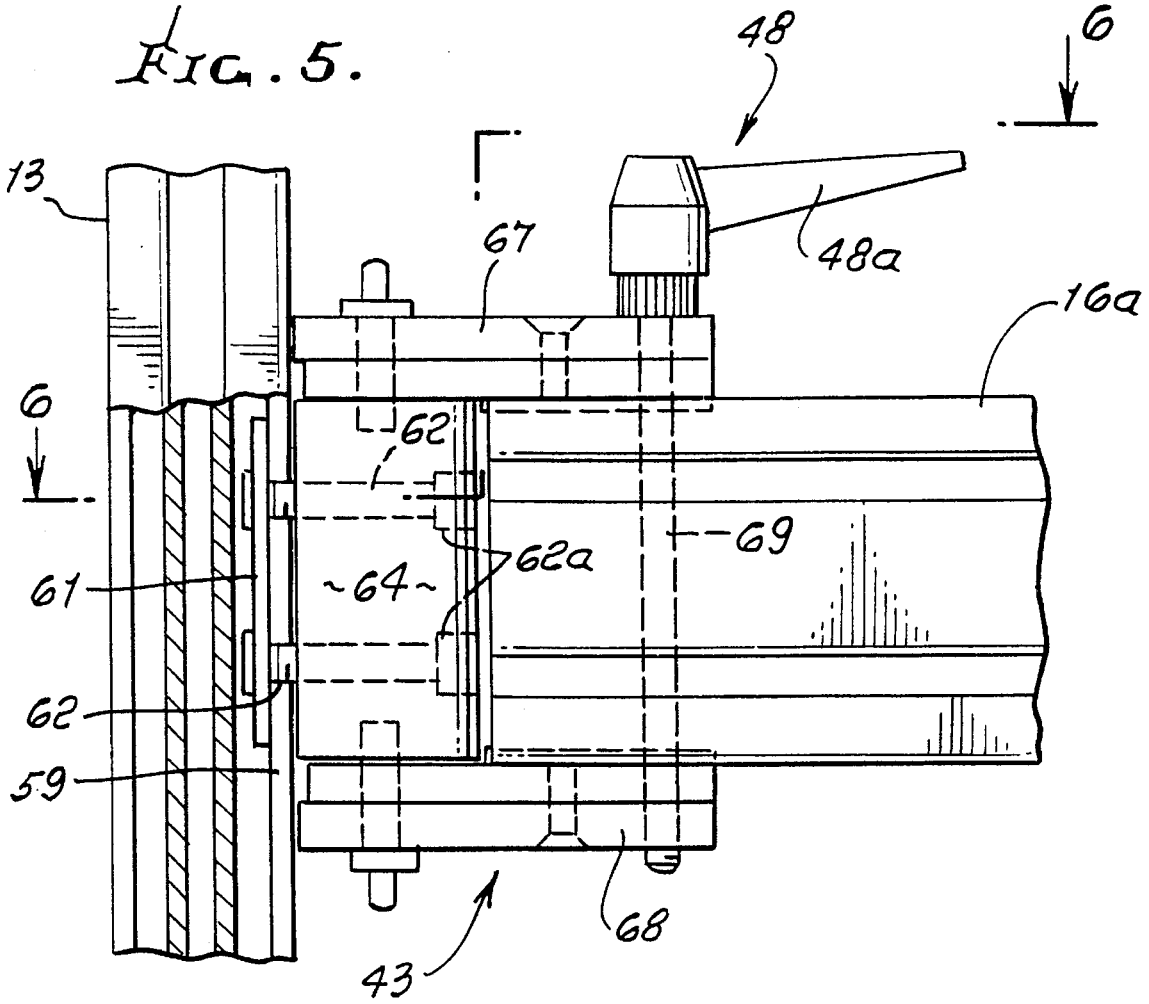
FIG. 5 is an enlarged fragmentary view taken on lines 5—5 of FIG. 3.
Figure 6:
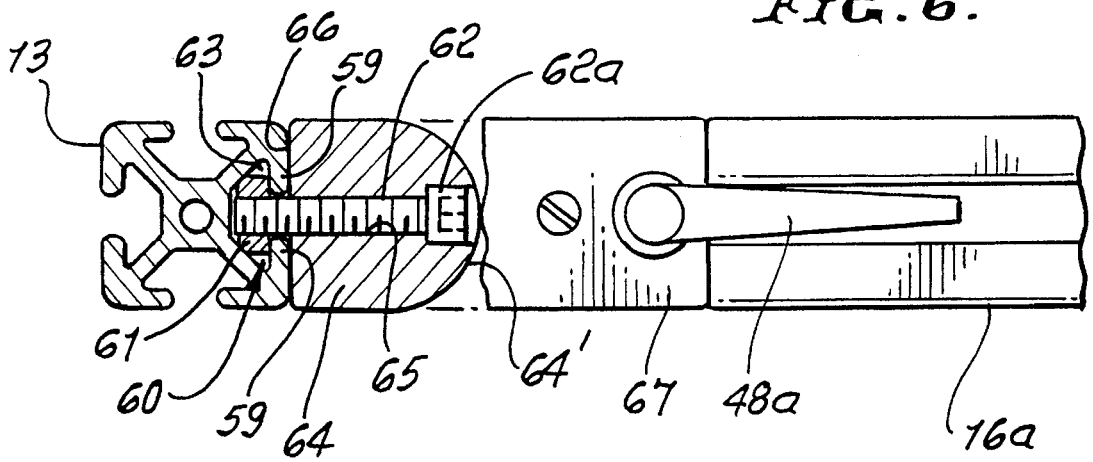
FIG. 6 is a top plan view taken on lines 6—6 of FIG. 5.

Referring to FIGS. 5 and 6, the illustrated primary height adjustment means 43 includes a vertical tongue and groove sliding connection at 60 between segment 16*a* and leg 13. Connection 60 includes a tongue provided by a nut 61 on a threaded bolt 62, the nut slidable vertically in a groove 63 in leg 13. Bolt 62 extends horizontally in a bore 65 in vertical clamp member 64, and can be tightened by rotating bolt head 62*a* to clamp member 64 to the side of leg 13, at interface 66, to establish adjusted height of segment 16*a* relative to the leg. Nut 61 then clamps against ribs 59 of the leg. This construction facilitates non-interfering vertical adjustment of both the means 43 and 44 on one leg 14, in view of provision of grooves 63 in the leg, as shown at 90° intervals.

Clamp horizontal arms 67 and 68 are vertically spaced to receive the end of segment 16*a* therebetween, as shown. An elongated vertical connector stem 69 extends in arms 67 and 68, and through segment 16*a*, whereby 16*a* can pivot about the vertical axis of that stem, relative to the clamp member 64 and arms 67 and 68. Stem 69 has threaded connection to arm 68, and can be rotated via pivoting of arm 48*a* on pivot structure 48 to clamp the arms 67 and 68 against the upper and lower sides of segment 16*a* to arrest pivoting of 16*a* relative to 69 and leg 13. When arm 48*a* is rotated to unclamp the segment 16*a*, relative rotation of 16*a* and 64 enables exposure of otherwise concealed bolt head 62*a* to enable its tightening or loosening by a tool to allow height adjustment, as described. See FIG. 6 showing rounded ends 64' of 64 to enable pivoting. Two such bolts 62 may be provided, as shown.

The described structures of the height adjustment means (elements 60–69) is repeated at each of the height adjustment means 44, 45, and 46, enabling height adjusting of the segments relative to the legs.

Figure 3:
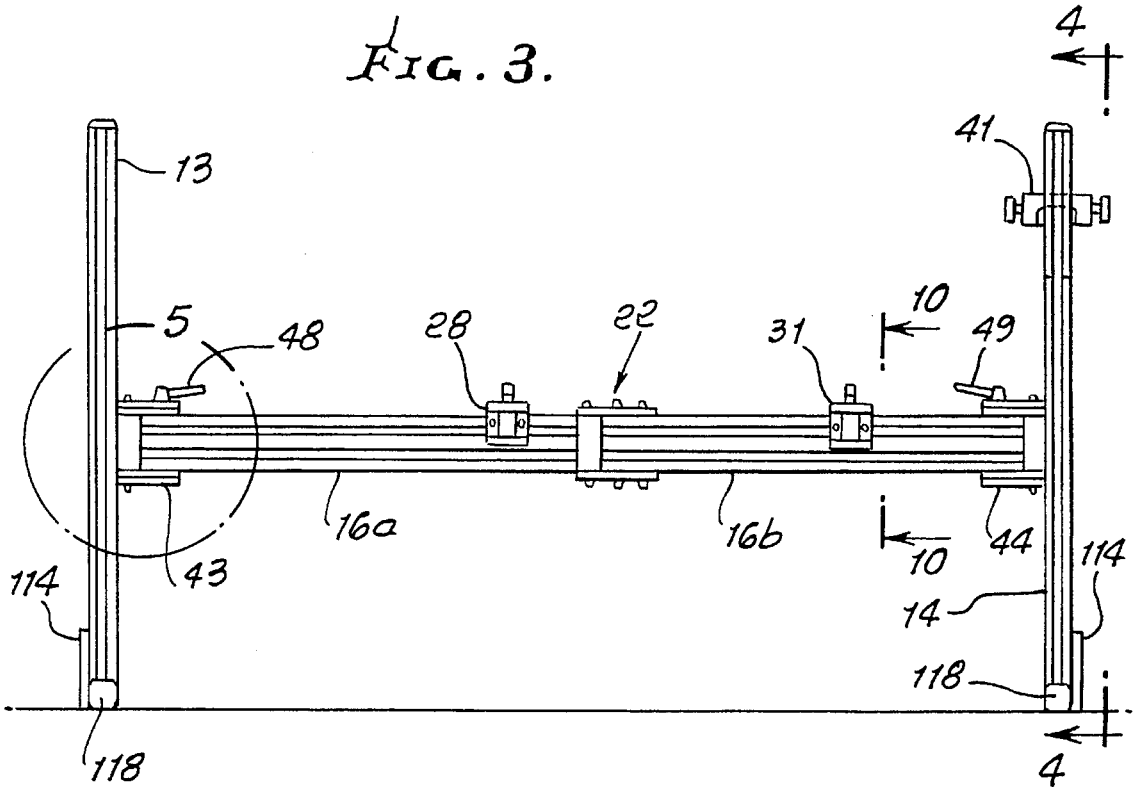
FIG. 3 is an elevation taken on lines 3—3 of FIG. 2.
Figure 4:
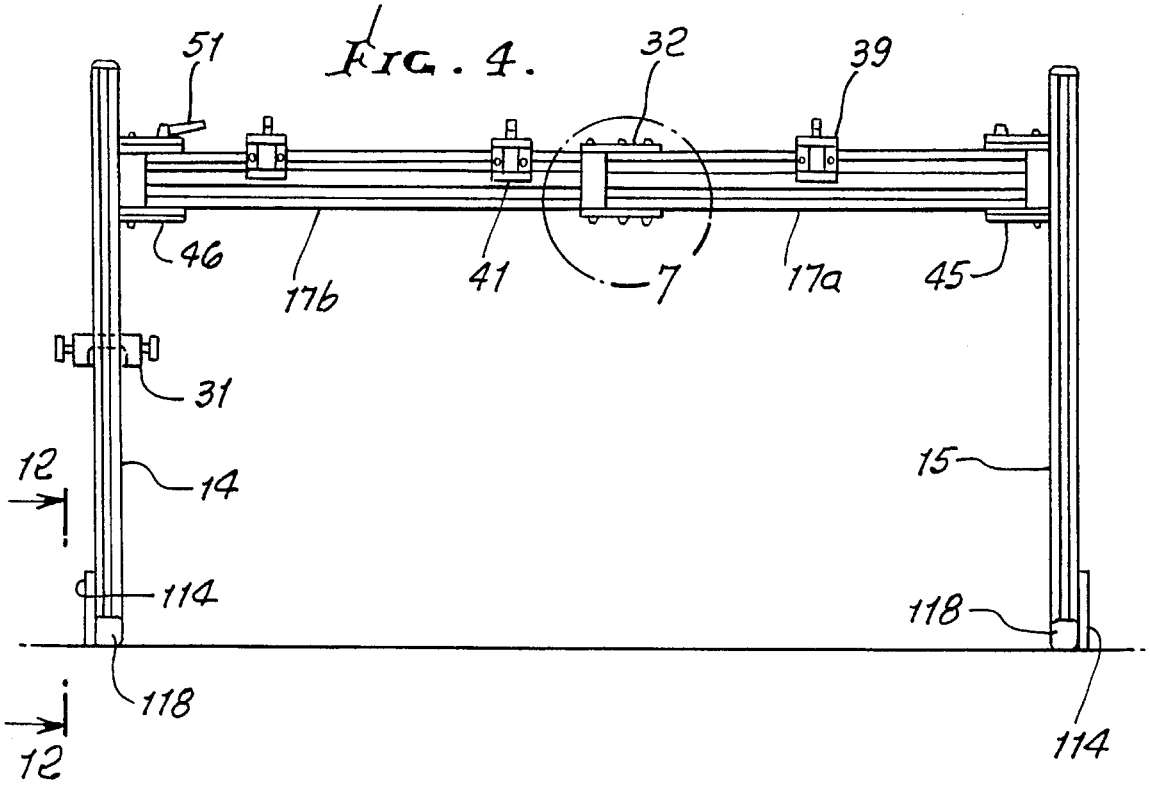
FIG. 4 is an elevation taken on lines 4—4 of FIG. 2.
Figure 7:
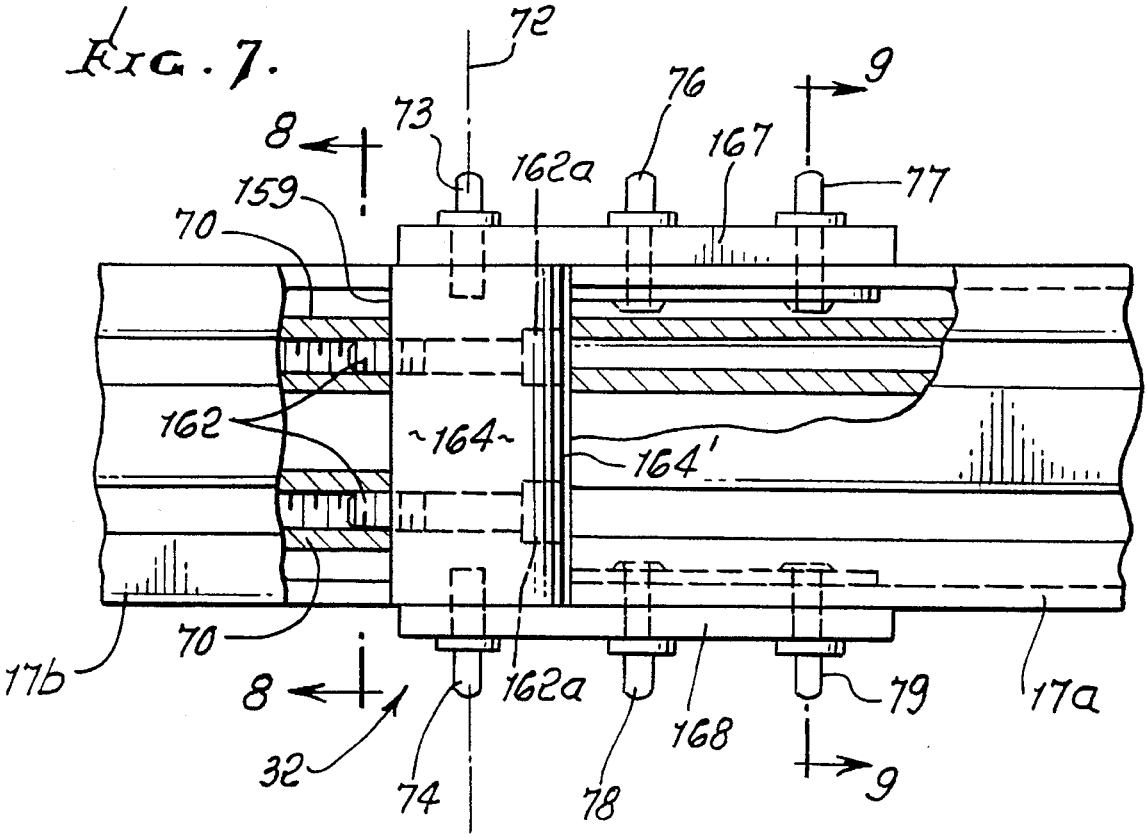
FIG. 7 is an enlarged fragmentary view taken on lines 7—7 of FIG. 4.
Figure 8:
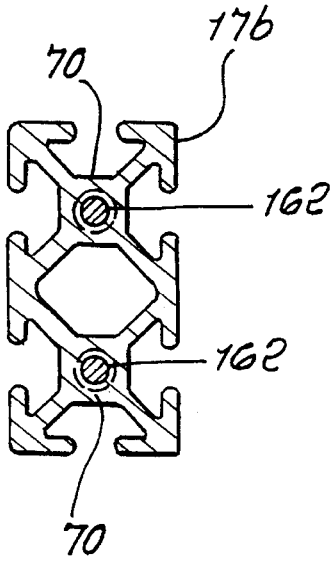
FIG. 8 is a section taken on lines 8—8 of FIG. 7.
Figure 9:
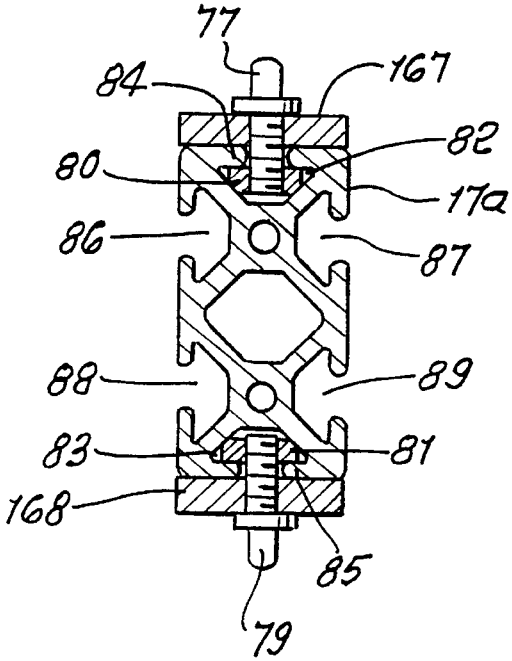
FIG. 9 is a section taken on lines 9—9 of FIG. 7.

Referring to FIGS. 7–9, the illustrated hinge structure 32, also seen in FIGS. 1–3, has the same C-clamp structure as was described in FIG. 5, and includes upright member 164, and horizontal arms 167 and 168 corresponding to 64, 67, and 68, respectively, for possible interchangeability. Bar segment 17*b* endwise abuts and connects at 159 to member 164 via bolts 162 having threaded ends threadably engaging sockets 70 in 17*b*. When tightened, the bolts clamp 164 to the end of 17*b*. The bolt heads 162*a* received in bores in 164 are exposed for tightening after pivoting of segment 17*a* and arms 167 and 168, relative to 164, about vertical pivot axis 72. Clamp fasteners 73 and 34 may be loosened to enable such pivoting; and side 164' of 164 is rounded to facilitate pivoting. Fastener 73 passes downwardly through arm 167 and into 164, to threadably connect thereto, and fastener 74 passes upwardly through arm 168 and into 164 to threadably connect thereto. Fasteners 76 and 77 attach arm 167 to the top of segment 17*a*; and fasteners 78 and 79 attach arm 168 to the bottom of 17*a*, as shown. When fasteners 73 and 74 are tightened, they serve to retain segments 17*a* and 17*b* at selected relatively pivoted positions, as seen in FIG. 2, for example.

FIGS. 8 and 9 show provision of nuts 80 and 81 in endwise grooves 82 and 83 in the top of segment 17*a*, to be tightened against flanges 84 and 85. See also multiple parallel grooves 86–89 in 17*a*, for reception of nuts and associated structure to support percussion equipment.

The structure and function of hinge structure 22 is the same as that of 32, for enabling relative pivoting of segments 16*a* and 16*b*, as described above. Each of the segments 16*a*, 16*b*, and 17*a* and 17*b* has the same structure, as shown in FIGS. 8 and 9, for ease of assembly at a performance.

Grooving 82 and 83 also facilitates attachment and adjustment shifting, endwise, of the supports 28, 31, 39, and 41, along their respective bar segments acting as rails, to adjustably position the percussion instruments, horizontally, without rotation about the length axes of the bar segments.

Figure 10:
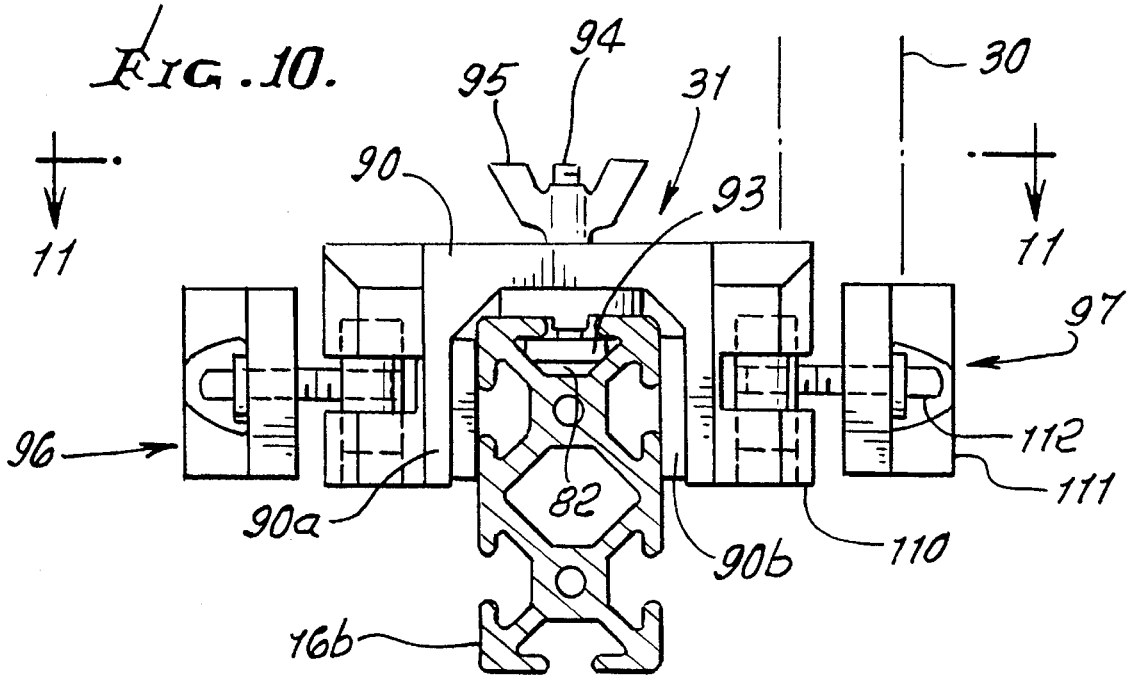
FIG. 10 is an enlarged section taken on lines 10—10 of FIG. 3.
Figure 11:
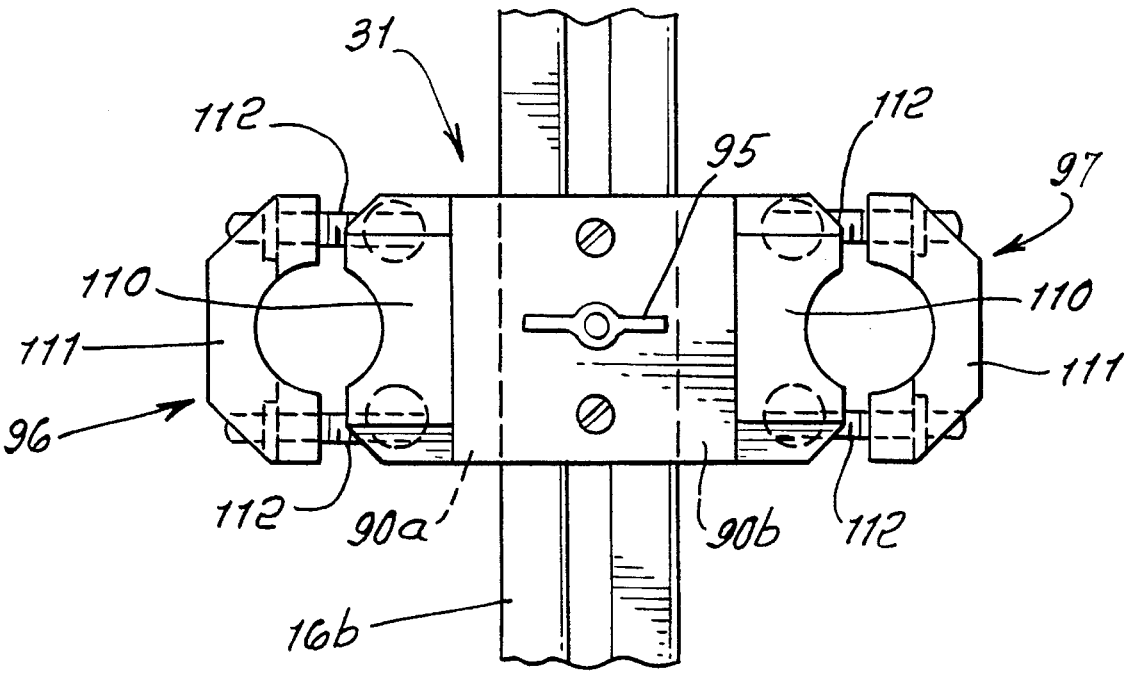
FIG. 11 is a fragmentary elevation taken on lines 11—11 of FIG. 10.

FIGS. 10 and 11 show representative C-shaped bracket 31 fitting downwardly on bar segment 16*b*. Bracket 31 includes top member 90 extending laterally over the top of 16*b*, and connected thereto via groove 82. A bolt head 93 fits in 82; and the bolt stem 94 projects upwardly through 90 for reception of a wing nut 95 clamping onto the top of 90. When the nut is loosened, the bracket (support) 31 is slidable endwise along 16*b* to adjusted position. Attachments 96 and 97 are provided at opposite sides of the bracket vertical members 90*a* and 90*b* to hold rods (as at 30) that support percussion instruments. Rod 30 is clamped between C-shaped attachment parts 110 and 111, and fasteners 112 may be tightened to achieve the clamp. See the similar structure associated with 90*a*.

Figure 12:
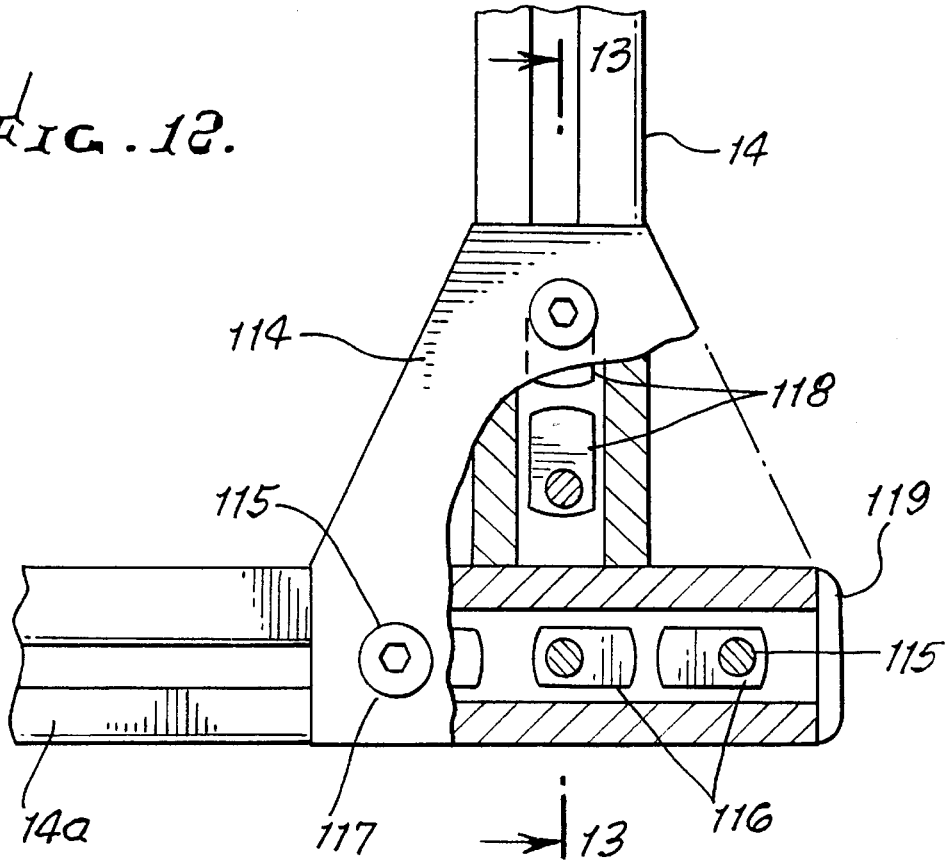
FIG. 12 is an elevation taken on lines 12—12 of FIG. 4.
Figure 13:
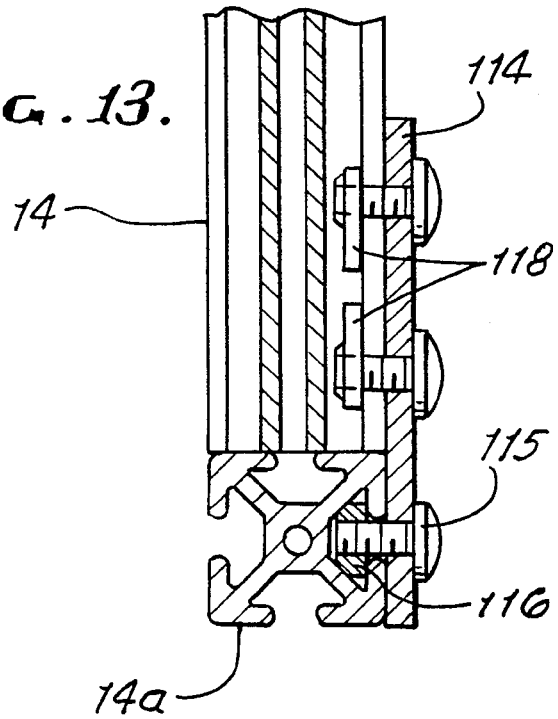
FIG. 13 is a section on lines 13—13 of FIG. 12.
Figure 14:
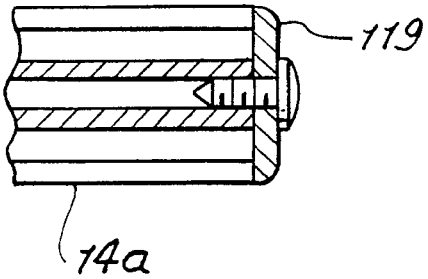
FIG. 14 is an end cap detail.

FIGS. 12–14 show bracket 114 attaching leg 14 to foot 14*a*. See bolt and nut parts 115 attached at 116 to the grooved leg, at 117 to the grooved foot, and at 119 to the leg. See also end cap 118 on 14*a*.

All structures may consist of lightweight metal.

I claim:

1. In an articulated support apparatus for percussion instruments, the combination comprising:

a) first, second and third upright legs, a primary elongated bar structure extending generally horizontally between and supported by the first and second legs, and a secondary elongated bar structure extending generally horizontally between and supported by the second and third legs, b) said primary bar structure including multiple primary elongated segments, and there being a primary hinge structure connecting at least two of said primary segments to relatively pivot about a primary vertical primary hinge axis, and whereby the second and first legs may be selectively relatively pivoted about said axis, c) and support means on at least one of said bar structures to support percussion instruments, d) said bar segments having substantially rectangular cross sections to slidably support said support means, e) and including primary height adjustment means on said two primary segments and on said first and second legs for enabling adjustment of the elevation of said primary bar structure relative to said first and second legs.

2. The combination of claim 1 wherein there are only two of said primary segments.

3. In an articulated support apparatus for percussion instruments, the combination comprising:

a) first, second and third upright legs, a primary elongated bar structure extending generally horizontally between and supported by the first and second legs, and a secondary elongated bar structure extending generally horizontally between and supported by the second and third legs, b) said primary bar structure including multiple primary elongated segments, and there being a primary hinge structure connecting at least two of said primary segments to relatively pivot about a primary vertical primary hinge axis, and whereby the second and first legs may be selectively relatively pivoted about said axis, c) and support means on at least one of said bar structures to support percussion instruments, d) said bar segments having substantially rectangular cross sections to slidably support said support means, e) and wherein said secondary bar structure includes multiple secondary elongated segments, and there being a secondary hinge structure connecting at least two of said secondary segments to relatively pivot about a secondary vertical hinge axis, and whereby the third and second legs may be relatively pivoted about said secondary vertical axis.

4. The combination of claim 3 including primary height adjustment means on said two primary segments and on said first and second legs for enabling adjustment of the elevation of said primary bar structure relative to said first and second legs.

5. The combination of claim 3 wherein there are only two of said secondary segments.

6. The combination of claim 3 wherein support means for percussion instruments are located on both of said bar structures.

7. The combination of claim 2 wherein said support means for percussion instruments are located on both said primary segments.

8. The combination of claim 5 wherein said support means for percussion instruments are located on both said secondary segments, and on both said primary segments.

9. The combination of claim 3 including secondary height adjustment means on said two secondary segments and on said second and third legs for enabling adjustment of the elevation of said secondary bar structure relative to said second and third legs.

10. The combination of claim 9 including primary height adjustment means on said two primary segments and on said first and second legs for enabling adjustment of the elevation of said primary bar structure relative to said first and second legs.

11. The combination of claim 1 including primary pivot structure associated with said primary height adjustment means and enabling pivoting of at least one of said primary segments relative to its associated leg to thereby enable adjustment of said primary height adjustment means.

12. The combination of claim 2 including primary pivot structure associated with said primary height adjustment means to enable pivoting of each of said two primary segments relative to its associated leg, to thereby enable adjustment of said primary height adjustment means.

13. The combination of claim 3 including secondary pivot structure associated with said secondary height adjustment means to enable pivoting of at least one of said secondary segments relative to its associated leg to thereby enable adjustment of said secondary height adjustment means.

14. The combination of claim 5 including secondary pivot structure associated with said secondary height adjustment means to enable pivoting of each of said two secondary segments relative to its associated leg, to thereby enable adjustment of said secondary height adjustment means.

15. The combination of claim 11 wherein said one segment has vertical sliding tongue and groove connection to one of said first and second legs, there being a clamp adjustable to clamp or loosen said connection after relative pivoting of said one segment and its associated leg.

16. The combination of claim 12 wherein said segments have vertical sliding tongue and groove connections to the respective first and second legs, there being clamps adjustable to clamp or loosen said connection after relative pivoting of said segments and said respective first and second legs.

17. The combination of claim 13 wherein said one segment has vertical sliding tongue and groove connection to one of said first and second legs, there being a clamp adjustable to clamp or loosen said connection after relative pivoting of said one segment and its associated leg.

18. The combination of claim 14 wherein said segments have vertical sliding tongue and groove connections to the respective first and second legs, there being clamps adjustable to clamp or loosen said connections after relative pivoting of said segments and said respective first and second legs.

19. The combination of claim 1 wherein said support means comprises a C-shaped bracket fitting downwardly over said one bar structure to be adjustably slidable thereallong.

20. The combination of claim 19 including rod clamps on said support means to clamp a percussion instrument support rod.

21. The combination of claim 3 wherein said second leg has vertically elongated substantially flat sides facing said first and third legs, said primary and secondary height adjustment means including non-interfering structures adjacent said flat sides of said second leg.

* * * * *